US005853237A

United States Patent [19]

Powell et al.

[11] Patent Number: 5,853,237

[45] Date of Patent: Dec. 29, 1998

[54] BASE FOR LATERAL FILE

[75] Inventors: Mark A. Powell, West Oliver; Thomas J. Osterman, Grand Haven, both of Mich.

[73] Assignee: Haworth, Inc., Holland, Mich.

[21] Appl. No.: 794,265

[22] Filed: Jan. 31, 1997

[51] Int. Cl.[6] ..... A47B 47/00

[52] U.S. Cl. ..... 312/257.1; 312/263; 312/330.1; 312/351.1

[58] Field of Search ..... 312/257.1, 263, 312/265.5, 265.6, 330.1, 351.1, 352, 400; 114/191, 188; 248/364, 910; 52/782.1, 782.24, 792.1

[56] References Cited

U.S. PATENT DOCUMENTS

| | | | |
|---|---|---|---|
| 1,333,264 | 3/1920 | Long | 312/330.1 |
| 2,012,803 | 8/1935 | Baker | 312/263 |
| 2,498,554 | 2/1950 | Klein | 312/265.6 |
| 3,341,270 | 9/1967 | Sohl | 312/257.1 X |
| 3,779,623 | 12/1973 | Motohashi | 312/257.1 |
| 4,662,689 | 5/1987 | Chatterson et al. . | |
| 4,692,984 | 9/1987 | McKernan et al. . | |
| 4,768,844 | 9/1988 | Ludwig . | |
| 4,881,779 | 11/1989 | Bubien | 297/442 |

FOREIGN PATENT DOCUMENTS

| | | | |
|---|---|---|---|
| 1477091 | 3/1967 | France | 312/265.5 |
| 2165324 | 7/1973 | Germany | 312/263 |
| 661161 | 11/1951 | United Kingdom | 52/782.24 |

*Primary Examiner*—Peter M. Cuomo
*Assistant Examiner*—Janet M. Wilkens
*Attorney, Agent, or Firm*—Flynn, Thiel, Boutell & Tanis, P.C.

[57] ABSTRACT

A lateral file cabinet includes an enclosure defined by top and bottom walls and first and second side walls which are spaced apart to define a hollow interior. The bottom wall includes a base panel formed of a wood fiber material such as particle board or chip board and the side walls include horizontal inward opening channels which receive opposite side edges of the base panel to define a structurally rigid connection therebetween. The base panel has a relatively high density which provides sufficient weight so as to completely or partially counter-balance the weight of a loaded file drawer to eliminate or reduce the weight of a separate counter-weight.

23 Claims, 5 Drawing Sheets

BASE FOR LATERAL FILE

FIELD OF THE INVENTION

The invention relates to a lateral file cabinet and, more particularly, a lateral file cabinet having a sheet metal housing and a structurally rigid bottom wall formed of a rigid non-metallic board material such as fiber board material.

BACKGROUND OF THE INVENTION

Lateral file cabinets, which are used in office areas for the storage of documents and files, typically include a box-like housing or enclosure which is open at the front and receives slidable drawers therein. The cabinet includes side walls which extend vertically and top and bottom walls which extend horizontally between the side walls to define a hollow interior thereof. All of these side walls and top and bottom walls typically are of sheet metal formed into rectangular panels and fixedly connected at their respective edges, such as by welding. The housing is sized to accommodate a predetermined number of drawers, commonly two to five drawers. Thus, when loaded, the lateral file cabinet is heavy which causes high loads to be applied to the welds particularly when moving the lateral file cabinet.

Further, the loaded-file drawers typically are counterbalanced by a heavy, plate-like metal counterweight that is suspended or hung along the back wall of the cabinet housing to prevent tipping when a drawer is opened. For a typical lateral file cabinet having a lateral width of approximately 42 inches, the weight of a counterbalancing plate is approximately 65 pounds. This significant weight makes it more difficult to reposition the cabinet during use, and often the counterweights are shipped separate from the cabinet which increases shipping costs.

In view of the foregoing, it is an object of this invention to provide an improved lateral file cabinet which has sufficient structural rigidity for supporting loaded file drawers therein. In particular, it is an object to provide a bottom wall which has an improved structural connection to the side walls of the cabinet and is made of a readily-formable and cost-efficient rigid material to provide increased rigidity to the cabinet. It is a further object to provide a lateral file cabinet which eliminates the need for or reduces the weight of a separate counterbalancing weight suspended within the hollow interior thereof. It is also an object to include a high-strength top wall preferably for a waist-high two-drawer version of the lateral file cabinet to prevent objects that may be placed on the cabinet from bending or denting the top wall.

To satisfy the aforesaid objects, the invention relates to a lateral file cabinet that has a bottom or base wall which comprises a base panel formed of a wood fiber material such as particle board or chip board. The bottom wall increases cabinet rigidity due to its structurally rigid connection to the side walls as well as its thickness which is significantly greater than the thickness of the sheet metal that is used to form the side and top walls. The bottom wall also has a relatively high density which provides a sufficient weight so as to completely or partially counterbalance the weight of a loaded file drawer to thereby eliminate or reduce the weight of a separate counterweight.

More particularly, the side walls of the cabinet housing are formed with inner and outer shells mated one with the other to define high-strength double walled sides of the cabinet which include rigid upright hollow tubes formed therein. The side walls each define a horizontal channel along the bottom edge thereof which receives the corresponding side edge of the base panel therein. The side walls are connected to the base panel by screws driven into both the top and bottom surfaces of the particle board bottom wall so as to provide vertically spaced connection areas or locations which effectively define a two-point connection between the side walls and the bottom wall. This two-point connection increases the structural rigidity of the cabinet in particular due to the significant thickness of the particle board bottom wall. The bottom wall also permits direct connection of support glides for the cabinet.

Further, the wood fiber bottom wall has a density in the range of 25 to 90 pounds per cubic foot (lbs./cu. ft.) and preferably a density of about 40 to 50 lbs./cu.ft., which provides a sufficient weight for completely or partially counterbalancing the loaded file drawers and thereby eliminates the need for or reduces the size of a separate counterbalancing plate as provided in conventional lateral file cabinets.

Still further, the top wall is formed of sheet metal so as to define a hollow interior thereof. The hollow interior preferably includes a particle board panel connected therein to define a structurally rigid top wall which is resistant to denting and marring.

Both the base panel and the top wall are readily removable from the side walls which allows these components to be shipped in a disassembled condition commonly referred to as a "knocked-down" condition. As a result, this knock-down file cabinet can be shipped in a smaller container and at less expense than a pre-assembled file cabinet. Thereafter, the components can be readily assembled together at home or in a non-factory environment.

Other objects and purposes of the invention, and variations thereof, will be apparent upon reading the following specification and inspecting the accompanying drawings.

Figure 1:
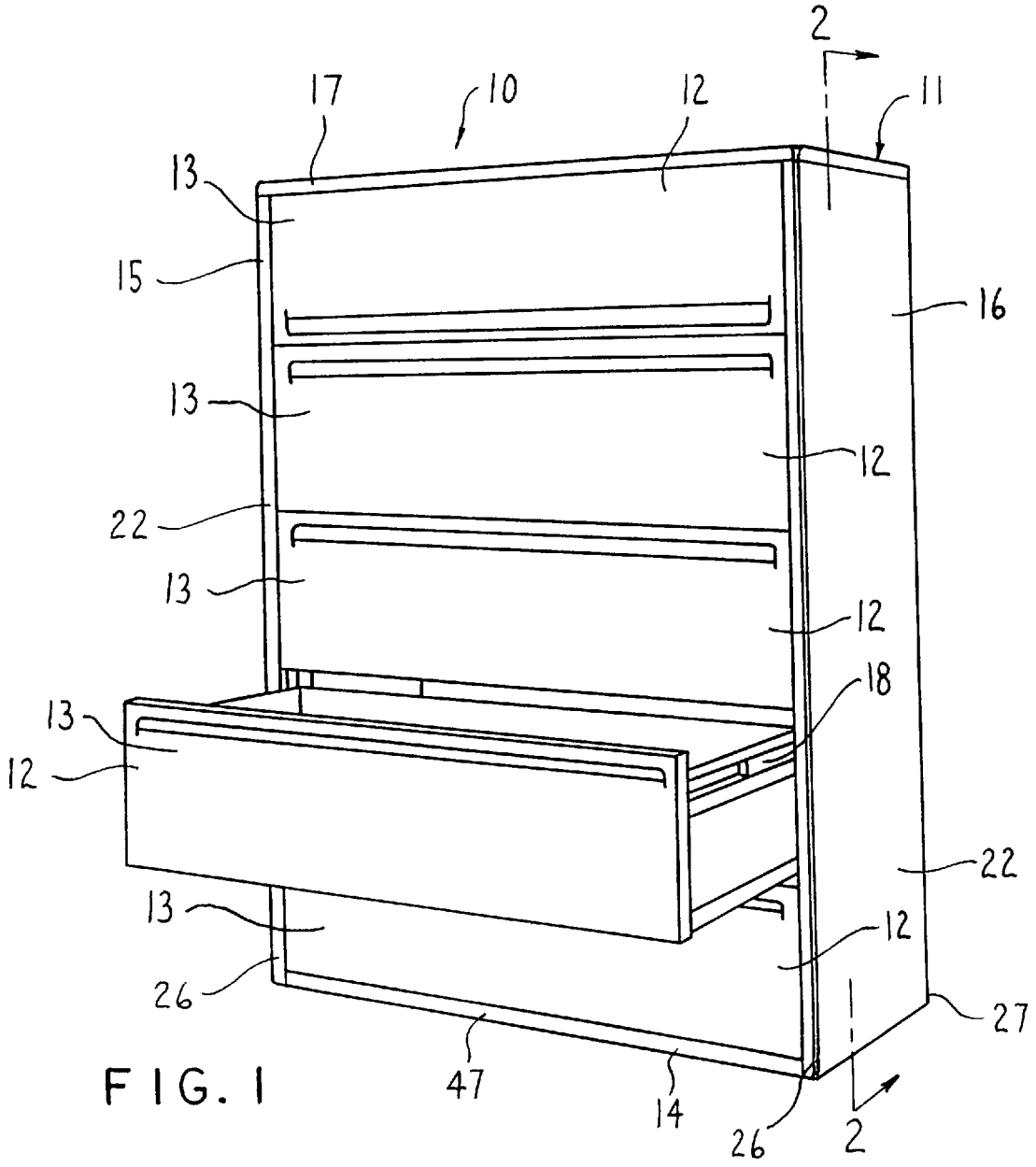
FIG. 1 is a front perspective view of a lateral file cabinet of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention relates to a lateral file cabinet 10 having a box-like hollow enclosure or housing 11 in which a plurality of upward opening file drawers 12 are slidably received. The file cabinet 10 includes a high-density particle board bottom wall 14 which increases the structural rigidity of the cabinet 10 and has a weight that at least partially counterbalances the weight of a loaded file drawer 12 when in the open position.

Generally, the housing 11 is substantially rectangular and is open on the front thereof for receiving the file drawers 12 in vertically adjacent relation. Each drawer 12 includes a front wall 13 as seen in FIG. 1. The housing 11 is defined by the bottom wall 14, vertically-enlarged rectangular left and right side walls 15 and 16 which extend upwardly from side edges of the bottom wall 14, and a top wall 17 which extends horizontally between the upper edges of the side walls 15 and 16. The front peripheral edge of the housing 11 defines a front opening in which a plurality of the file drawers 12 are positioned in a conventional arrangement. The housing 11 thereby defines upper, lower, left side and right side edges of the opening. Each file drawer 12 is connected at its opposite ends to the respective side walls 15 and 16 by conventional drawer slides 18 so as to be slidable into and out of the cabinet housing 11 between closed and open positions generally illustrated in FIG. 1. The particular construction of the drawers 12 and drawer slides 18 is conventional and thus a more detailed description of these components is not believed necessary.

Figure 2:
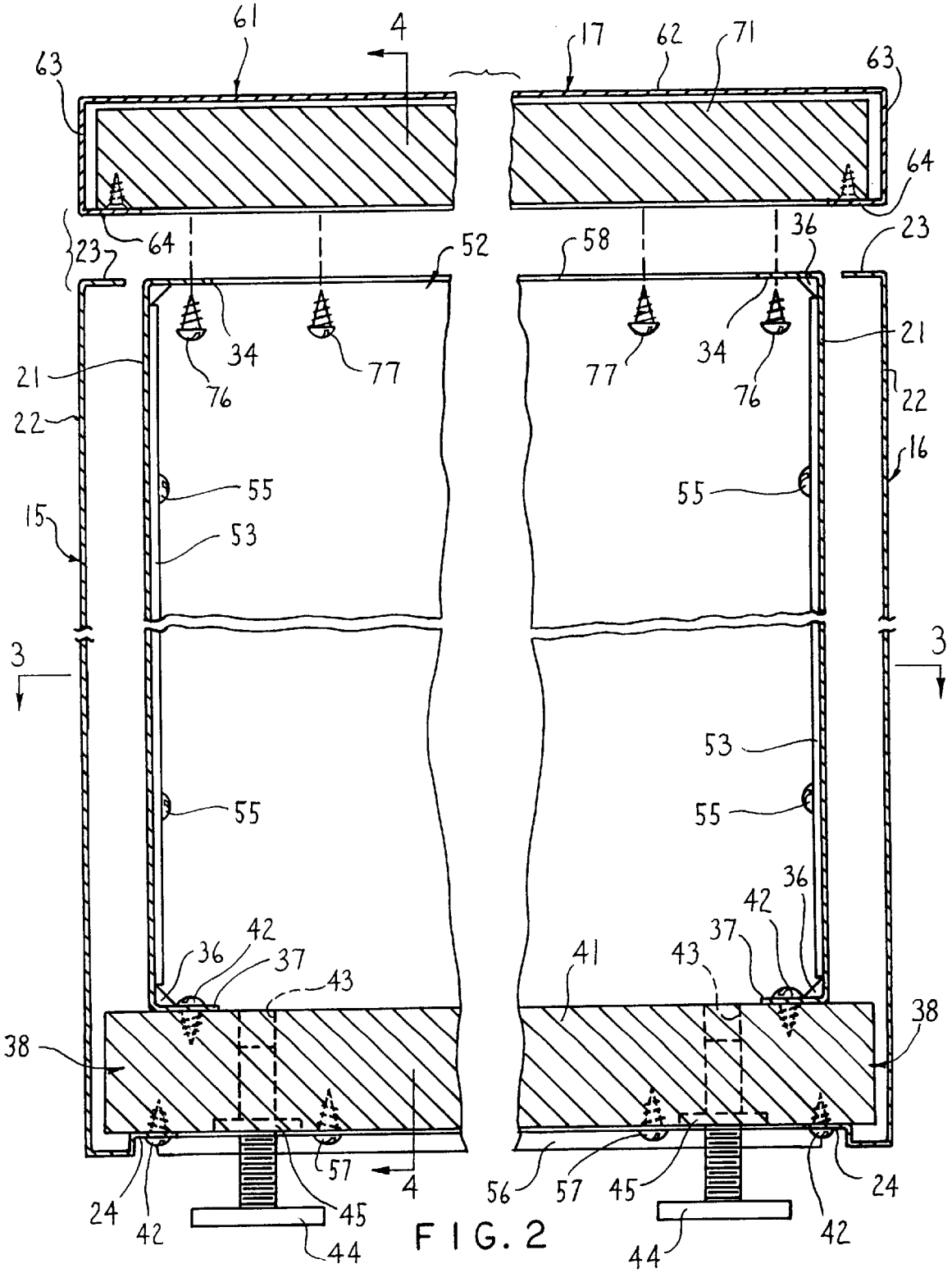
FIG. 2 is a broken front elevational view in cross section illustrating the lateral file cabinet with drawers and drawer slides removed and the top wall disposed in an exploded position as viewed in the direction of arrows 2—2 of FIG. 1.
Figure 3:
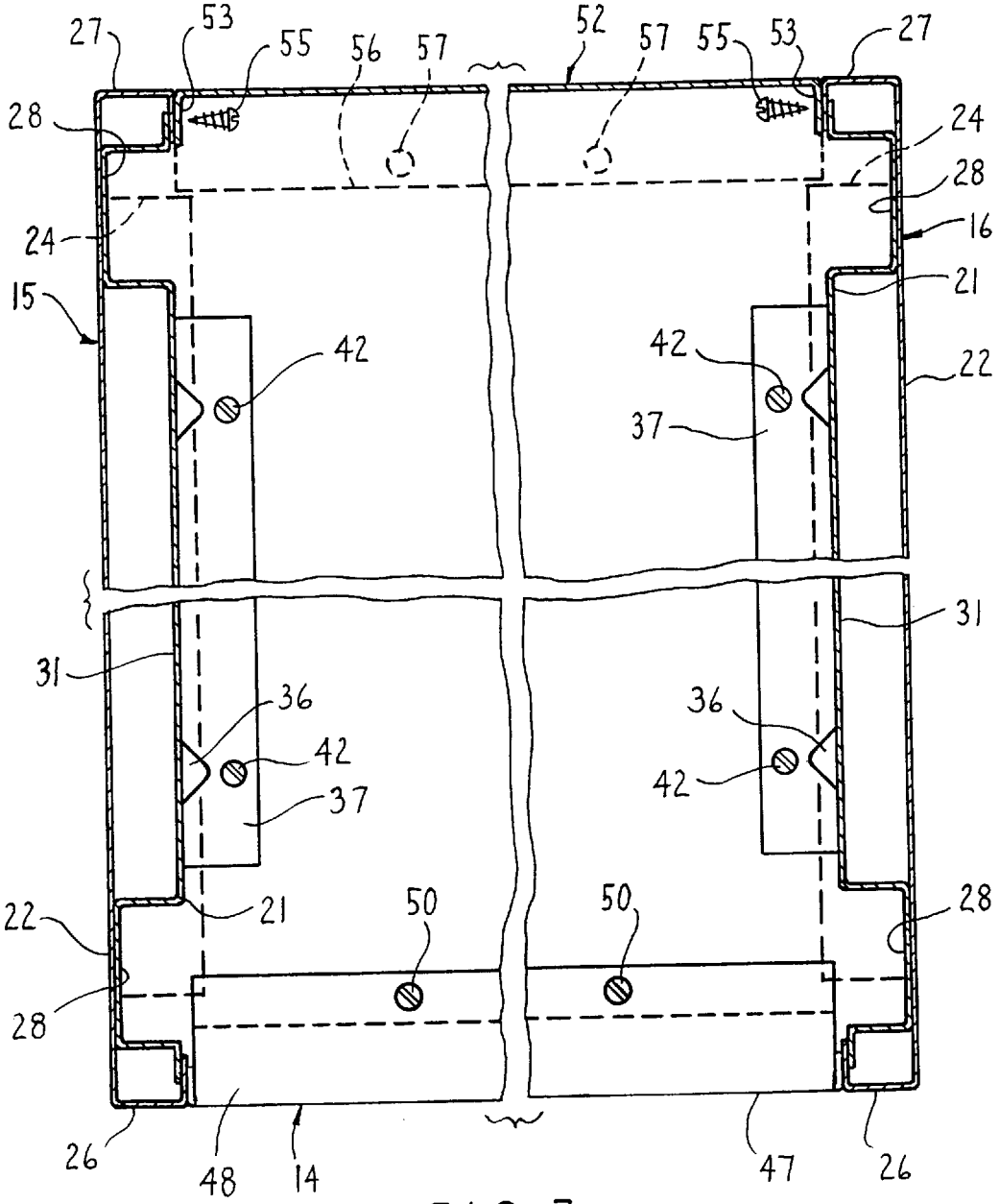
FIG. 3 is a broken top plan view in cross section illustrating the file cabinet as viewed in the direction of arrows 3—3 of FIG. 2.

Referring to FIGS. 2 and 3, each side wall 15 and 16 has a double-wall sheet metal construction formed by an inner liner or shell 21 and an outer side panel 22 which are joined together in facing relation to define a vertically enlarged rectangular panel. The left and right side walls 15 and 16 are substantially the same except that they are mirror-images of one another.

More particularly, each outer side panel 22 is a substantially rectangular sheet metal panel which extends upwardly to define the height of the file cabinet 10. The outer panel 22 may, for example, be formed of 22 gage sheet steel.

Figure 4:
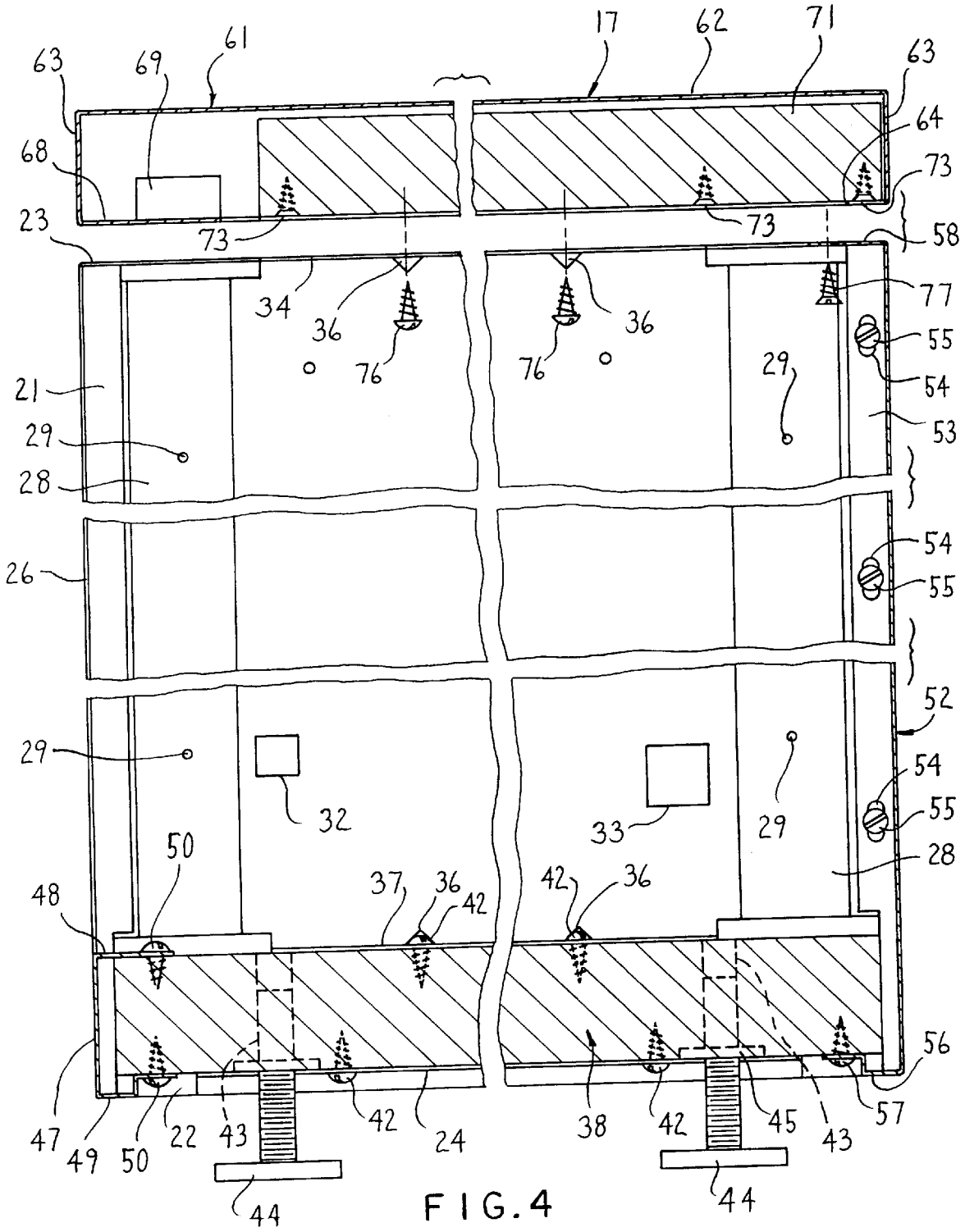
FIG. 4 is an exploded broken right side elevational view of the file cabinet as viewed in the direction of arrows 4—4 of FIG. 2.

The outer panel 22 includes a horizontal upper flange 23 which extends inwardly toward the interior of the housing 11 and is formed along the length of the horizontal upper edge of the outer panel 22. The outer panel 22 also includes a stepped or Z-shaped lower flange 24 which also extends inwardly and is formed along but not entirely across the horizontal lower edge of the outer panel 22 as can be seen in FIG. 4. The flange 24 includes a plurality of apertures along the horizontal length thereof for the connection of the side walls 15 and 16 to a bottom surface of the bottom wall 14 as described hereinafter. As seen in FIG. 3, the outer panel 22 also includes right-angle bends along the opposite vertical edges thereof to define front and rear vertical corners 26 and 27 (FIG. 3) of the housing 11.

Referring to FIGS. 2 and 3, the inner liner 21 is a substantially rectangular sheet metal panel which mounts to the inside surface of the outer panel 22 so as to define a double-wall when joined together. In this double-wall arrangement, the inner liner 21 substantially overlies the outer panel 22 in opposing relation therewith such that the interior wall surface of the side walls 15 and 16 is defined by the inner liner 21 while the exterior wall surface is defined by the outer panel 22. As described hereinafter, this double-wall arrangement increases the rigidity of the side walls 15 and 16 and cooperates with the base wall 14 to increase the overall rigidity of the cabinet 10.

The inner liner 21 may be formed, for example, of 18 gage sheet steel. The inner liner 21 is bent to define vertical strengthening channels 28 which abut against the inside surfaces of the outer panel 22 and are fastened thereto by spot welds 29 (FIG. 4). In the preferred embodiment, the strengthening channels 28 are positioned adjacent and extend vertically proximate the front and rear edges of the side panels 15 and 16.

In the region intermediate the strengthening channels 28, the inner liner 21 defines a drawer mounting wall section 31 to which the drawer slides 18 (FIG. 1) are mounted. More particularly, the wall section 31 is parallel to but spaced inwardly from the outer panel 22 to define a rigid upright hollow tube which increases the rigidity of the side walls 15 and 16 and allows for the connection of drawer slides 18 thereto. As seen in FIGS. 3 and 4, the drawer mounting wall section 31 includes rectangular front and rear apertures 32 and 33 respectively. A plurality of the front and rear apertures 32 and 33 are provided in the drawer mounting wall section 31 in vertically spaced relation so as to permit a plurality of the drawer slides 18 to be mounted thereto in a conventional manner. Since the drawer slides 18 and the methods of mounting same are conventional, further discussion or illustration of the drawer slides 18 is not believed necessary.

The drawer mounting wall section 31 also includes an upper flange 34 (FIGS. 2 and 4) which extends inwardly from the upper edge thereof and is strengthened by triangular gussets 36. The upper flange 34 is formed with a plurality of apertures which are spaced front to back along the horizontal length thereof for connection of the top panel 17 to the side walls 15 and 16 as described herein.

The drawer mounting section 31 further includes a lower flange 37 which extends inwardly therefrom and is also strengthened by gussets 36. The lower flange 37 includes a plurality of apertures along the horizontal length thereof for connection of the side walls 15 and 16 to an upper surface of the bottom wall 14 as described in detail hereinafter. When the inner liner 21 and outer side panel 22 are joined together, the respective lower flanges 37 and 24 are vertically spaced apart as shown in FIGS. 2–4 so as to define a horizontal channel 38 therebetween which extends along the horizontal length of the side walls 15 and 16. More particularly, the channel 38 is defined on three sides by the flanges 37 and 24 and the portion of the outer panel 22 extending vertically therebetween, and has an open side which opens towards the interior of the housing 11. As described hereinafter, these horizontal channels 38 of the side walls 15 and 16 receive opposite side edges of the bottom wall 14 therein to provide an improved structural connection therebetween which, in combination with the double-wall construction of the side walls 15 and 16, increases the overall rigidity of the cabinet 10.

The bottom wall 14 includes a rectangular particle board solid base panel 41 which extends sidewardly between the left and right side walls 15 and 16 and rearwardly between the front and rear edges of the cabinet housing 11. The particle board base panel 41 has a thickness which is significantly greater than the sheet metal used to construct the remainder of the housing 11 and which substantially corresponds to the vertical distance between the lower flanges 24 and 37. Preferably, the thickness is preferably at least about one inch thick. In one configuration of the cabinet 10, the bottom panel 41 is a solid piece of material that preferably is 42 inches wide between the side walls 15 and 16, 18 inches deep and has a thickness of 1.25 inches.

To join the side walls 15 and 16 and bottom wall 14 together, the opposite side edges of the particle board panel 41 are slid into the respective channels 38 of the side walls 15 and 16. More particularly, each side edge of the panel 41 is slid sidewardly relative to the respective channel 38 into the open side thereof and is positioned closely adjacent the portion of the outer panel 22 which defines the back of the channel 38. The panel 41 is then rigidly connected to the side walls 15 god and 16 by threaded fasteners 42 such as screws which are driven from above through the flange 37 of the inner liner 21 and from below through the flange 24 of the outer panel 22. Nails, staples or other fasteners are usable as alternatives to screws. It is also possible to eliminate the pre-formed apertures in the flanges 37 and 24, for example, when using nails or staples, since the nails or staples could be driven directly through the sheet metal of the flanges 37 and 24 and into the bottom panel 41. As a result, the bottom panel 41 is connected to the side walls 15 and 16 at vertically spaced mounting locations which effectively define a two-point connection between the side walls 15 and 16 and the bottom panel 41. This two-point connection provides a structurally rigid joint between the bottom wall 14 and the side walls 15 and 16 since the joint is defined across a substantial vertical distance and the loads are carried by both the inner liner 21 and the outer shell 22.

The bottom panel 41 preferably is formed of a manufactured non-metal material such as wood particle-board or wood chip-board material or other suitable rigid material such as a plastic which provides the desired thickness for the connection to the channels 38 as well as the desired density for partially or completely counterbalancing the file drawers 12. The preferred material is a manufactured wood product such as the aforementioned fiber-board or chip-board or in other examples, plasticized wood which is a mixture of wood and plastic, or oriented-strand wood fiber material. Such materials are preferred since they are cost-efficient and readily formable to any desired size and shape. Still further, such materials are particularly suitable for embedding fasteners therein to connect the side walls 15 and 16.

The density of the bottom panel 41 is in the range of about 25 to 90 pounds per cubic foot (lbs./cu. ft.) and in the preferred range of about 40 to 50 lbs./cu. ft. The density of the base panel 41 is selected so as to provide a sufficient weight which effectively serves as a complete or partial counterbalance for the weight of a loaded file drawer 12 in combination with the weight of the cabinet 11. The bottom panel 41 thereby can eliminate the need for or reduce the size of a separate counterbalancing weight which is independently mounted to the rear wall of a cabinet, and also provides an improved structural rigidity for the file cabinet 10.

Preferably, the bottom wall 14 also includes a plurality and preferably four vertical bores 43 which open from the bottom surface of the bottom panel 41 and are adapted to receive height-adjustable feet or glides 44. The glides 44 are threadingly engaged with a corresponding mounting plate 45 which is fixedly connected to the bottom surface of the bottom panel 41 such that the total weight of the file cabinet 10 is supported by the bottom panel 41. The glides 44 further permit leveling of the cabinet 10 by rotation of the glides 44 into and out of the mounting plate 45.

The bottom wall 14 further includes a U-shaped sheet metal channel 47 (FIGS. 3 and 4) which fits over the front edge of the bottom panel 41 to provide a finished surface thereto. The channel 47 includes inwardly extending top and bottom legs 48 and 49 which are secured to the respective top and bottom surfaces of the bottom panel 41 by fasteners 50. The channel 47 primarily is provided for aesthetics so that the visible front surface of the bottom wall 14 has a finished metal surface like the remainder of the visible surfaces of the file cabinet 10.

The cabinet housing 11 is enclosed on a back side thereof by a sheet metal back wall 52 (FIGS. 2–4) which extends sidewardly between the side walls 15 and 16 and vertically between the bottom wall 14 and the top wall 17. The back wall 52 is formed, for example, of 22 gage sheet steel and includes inwardly extending vertical side flanges 53 along the opposite vertical edges thereof which connect to the side walls 15 and 16. The side flanges 53 include vertically spaced apertures 54 through which fasteners 55 are engaged into the side walls 15 and 16. The back wall 52 also includes a horizontal stepped or Z-shaped bottom flange 56 along the bottom edge thereof which extends inwardly and is fastened to the bottom surface of the bottom panel 41 by fasteners 57. To connect the top wall 17 to the back wall 52, the back wall 52 also includes a top flange 58 which extends inwardly and is formed along the top horizontal edge of the back wall 52. The flange 58 is formed with suitable apertures along the length thereof for connection of the top wall 17.

Figure 5:
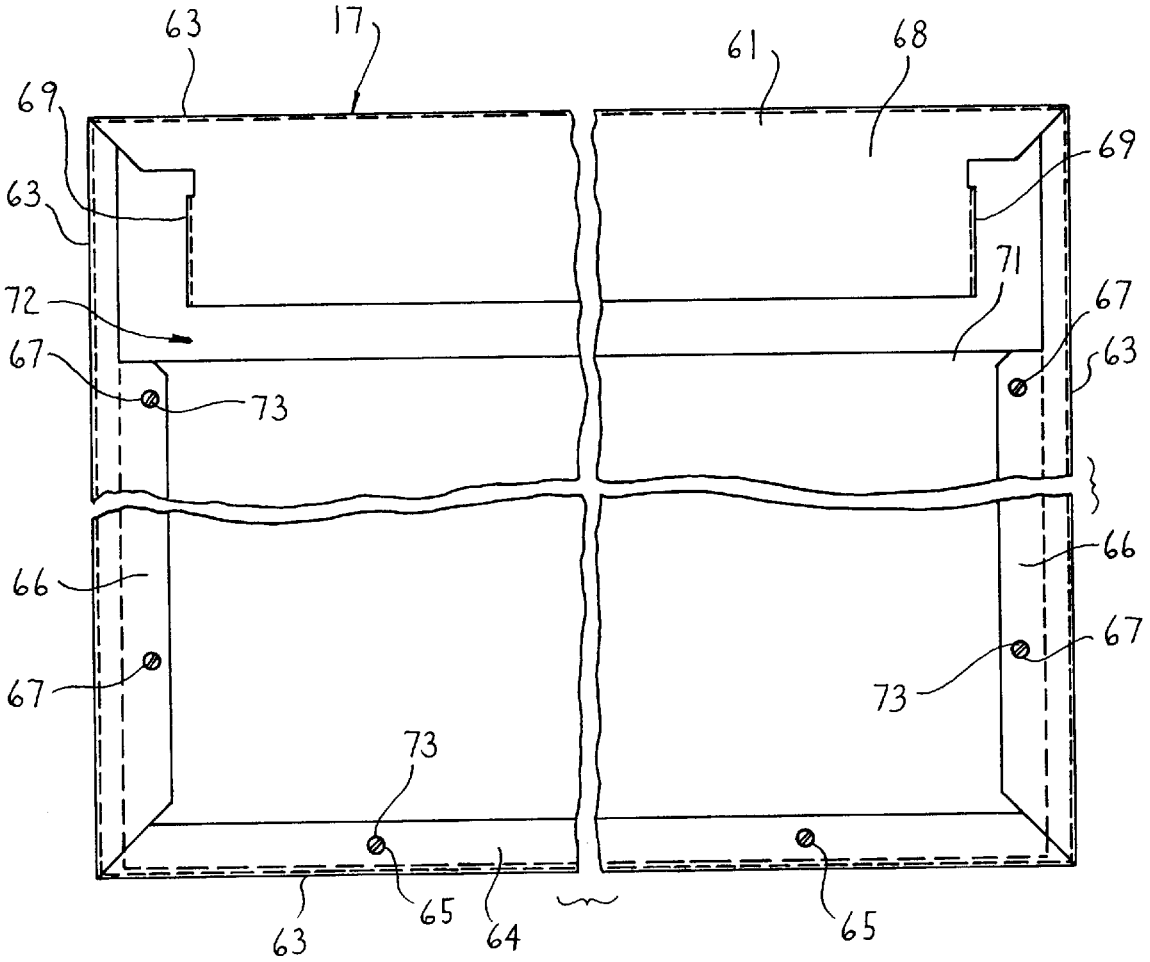
FIG. 5 is a broken bottom view of the top wall.

Referring to FIGS. 2, 4 and 5, the top wall 17 includes a hollow sheet metal housing 61 formed, for example, of 22 gage sheet steel. The top housing 61 includes a rectangular horizontal top surface 62 and downwardly depending side flanges 63 which are formed around the peripheral edge of the top surface 62 to define a box-like shape for the top wall 17. The side flanges 63 at their lower edges define thereon inwardly projecting flanges including a rear flange 64 having a plurality of apertures 65 formed therethrough, side flanges 66 which have apertures 67 formed therethrough and a front flange 68 which projects inwardly from the front side flange 63. The front flange 68 further includes upwardly extending flanges or tabs 69 which are used to support a lock mechanism (not illustrated).

To further strengthen the top wall 17, a rectangular insert 71 preferably formed of a particle-board material is inserted through the rectangular opening 72 (FIG. 5) which is formed between the flanges 64, 66 and 68. The side flanges 66 thereby defining left and right side edges of the opening 72. More particularly, a leading side edge of the insert 71 is inserted sidewardly through the opening 72 into the space between the respective side flange 66 and the top surface 62. When the leading side edge abuts against the side edge 63, the trailing edge of the panel 71 is then able to be moved vertically through the opening 72 and thereafter, the insert 71 is backed up within the open interior of the housing 61 until the opposite side edges thereof are supported by the side flanges 66. The insert 71 is also moved rearwardly toward the rear side edge 63 so that the rear edge of the insert 71 is supported by the rear flange 64. Preferably, the material of insert 71 is the same as that used for the base panel 41.

In this embodiment where the insert 71 is used, fasteners 73 are inserted through the apertures 65 and 67 of the respective rear and side flange 64 and 66 to fixedly secure the insert 71 within the hollow interior of the top wall housing 61. The top wall 17 is then placed on top of the upper flanges 23 and 34 of the respective side walls 15 and 16 and is secured thereon by fasteners 76 which are inserted through the flanges 34 of the inner liners 21 and are embedded within the particle board insert 71. Additional fasteners 77 are inserted through the top flange 58 of the back wall 52 and also embedded within the bottom surface of the insert 71. Thus, the top wall 17 is mounted in place to the side walls 15 and 16 and the back wall 52. It should be understood that the insert 71 may be omitted and that the top housing 61 can be formed so that the flanges 64 and 66 extend inwardly an additional distance such that the apertures thereof align with the corresponding apertures in the flanges 34 and 58 of the respective side walls 15 and 16 and the back wall 52. As a result, the fasteners can be directly connected between flanges 64, 66 and 68 of the top wall 17 and the flanges 34 and 58 of the side walls 15 and 16 and the back wall 52.

In the lateral file cabinet 10 described above, the connection of the side walls 15 and 16 to the bottom wall 14 has an improved structural rigidity. This improved connection is provided by the double-walled side walls 15 and 16 which are formed with the upright rigid hollow tube therein, and by the channel 38 in which the opposite ends of the base panel 41 are received. In particular, the improved connection is provided by the two-point connection between the side walls 15 and 16 and the top and bottom surfaces of the bottom panel 41. Additionally, separate, independent counterweights are thereby eliminated or reduced in size, and instead the bottom wall 14 in combination with an increased weight of the housing 12 serves to counterbalance the weight of loaded file drawers 12 when in the open position generally as seen in FIG. 1. As a result, the lateral file cabinet 10 can be shipped as a single unit and is ready for use with minimal assembly required.

Further, since the cabinet components, namely the bottom wall 14, side walls 15 and 16, top wall 17 and back wall 52, are connected together by removable threaded fasteners, the cabinet 10 can be shipped in a disassembled knocked down condition. As a result, the size of the shipping container and the shipping expenses therefor can be reduced. The cabinet components thereafter can be assembled at home or in a non-factory environment. The above-described cabinet 10 is particularly suitable for use as a knock-down cabinet since the difficulties associated with shipping and installing a separate counterbalancing weight are eliminated.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a lateral file cabinet including a hollow box-like enclosure having a hollow interior which is open on a front thereof, said enclosure being defined by a horizontally enlarged bottom wall, first and second laterally spaced apart side walls extending upwardly from said bottom wall, a horizontally enlarged top wall extending horizontally between said side walls, and a vertically enlarged back wall connected to said first and second side walls and said top and bottom walls, said file cabinet including at least one drawer slidably received within said enclosure above said bottom wall and slide means for connecting said drawer to said enclosure such that said drawer is horizontally slidable into and out of said hollow interior between respective closed and open positions, comprising the improvement wherein said side walls each include a horizontally elongate channel proximate said bottom wall, said channels opening inwardly in opposing relation to one another, said bottom wall including a horizontally enlarged base panel having opposite side edge regions fixedly seated within said channels of said side walls respectively, said side walls being formed of sheet metal, and said base panel being formed of a relatively thick non-metal material having a density of about 25 pounds per cubic foot or more so as to counterbalance said drawer when in said open position.

2. The file cabinet according to claim 1, wherein each said side wall includes inwardly extending upper and lower flanges which are vertically spaced apart to define said channel therebetween, fastener means being provided for connecting said upper and lower flanges respectively to upper and lower surfaces of said base panel.

3. The file cabinet according to claim 2, wherein said fastener means comprise fasteners engaged with said enclosure and fixedly embedded in said base panel to join said enclosure and said base panel one with the other.

4. The file cabinet according to claim 2, wherein each said side wall is defined by an inner shell and an outer shell disposed in opposing relation, said upper flange being disposed along a lower edge region of said inner shell and said lower flange being disposed along a lower edge region of said outer shell.

5. The file cabinet according to claim 1, wherein said density is in the range of 25 to 90 pounds per cubic foot.

6. The file cabinet according to claim 5, wherein said base panel is formed of a solid manufactured wood material.

7. The file cabinet according to claim 1, wherein said base panel includes a plurality of vertically extending bores formed therein, each said bore including a load-bearing support member engaged therewith for supporting said cabinet.

8. In a lateral file cabinet including a hollow box-like enclosure which has a hollow interior and defines a front opening on a front thereof, said enclosure being defined by a horizontally enlarged bottom wall, first and second laterally spaced apart side walls extending upwardly from said bottom wall, a horizontally enlarged top wall extending horizontally between said side walls, and a vertically enlarged back wall connected to said side walls and said top and bottom walls, said file cabinet including a plurality of laterally elongate drawers which extend horizontally between said side walls and are slidably received within said enclosure above said bottom wall and slide means for connecting said drawers to said enclosure such that said drawers are disposed vertically one above the other and each said drawer is slidable into and out of said hollow interior between respective closed and open positions, said opening having a lower edge defined by said enclosure and a lower one of said drawers having a front wall extending upwardly from said lower edge of said front opening comprising the improvement wherein said side walls, said top wall and said back wall are formed of sheet metal and said bottom wall includes a horizontally enlarged base panel which is disposed below said drawers and is connected to said enclosure proximate said side walls along respective side regions thereof, said base panel being a manufactured wood material having a predetermined density so as to define a weight thereof to counterbalance a weight of at least one of said drawers when disposed in said open position.

9. The file cabinet according to claim 8, wherein said density in the range of 25 to 90 pounds per cubic foot.

10. The file cabinet according to claim 8, wherein said side walls have a first thickness and said base panel has a second thickness several times greater than said first thickness.

11. The file cabinet according to claim 8, wherein said base panel has a top surface and a bottom surface and said side walls are connected to said base panel at a first location proximate said bottom surface and at a second location vertically spaced above said first location proximate said top surface.

12. The file cabinet according to claim 11, wherein said side walls each include an outer shell and an inner shell disposed in opposing relation on an inward side of said outer shell, said outer shell and said inner shell being connected to said base panel at said first location and said second location respectively.

13. The file cabinet according to claim 12, wherein one of said inner and outer shells is formed with a channel to define an upright hollow tube when joined together.

14. The file cabinet according to claim 8, wherein said top wall is defined by a sheet metal outer housing having a hollow interior which has a transverse width defined between opposite first and second housing sides of said housing, and an opening which opens vertically into said hollow interior, said opening having opposite first and second side edges defined by said housing which are spaced transversely from said first and second housing sides respectively to define a transverse width of said opening which is less than said transverse width of said hollow interior, a wood material top panel being secured within said hollow outer housing to provide rigidity thereto, said top panel having a transverse width which is less than a distance between said first housing side and said second side edge so that said top panel is insertable transversely through said opening, said transverse width of said top panel being greater than said transverse width of said opening.

15. A file cabinet comprising:

a box-like hollow enclosure defined by first and second side walls which are formed of sheet metal and extend vertically in substantially parallel spaced relation, a sheet metal back wall which extends sidewardly between said first and second side walls, and top and bottom walls which extend horizontally between respective top and bottom edge regions of said first and second side walls, said first and second side walls each including an outer shell and an inner shell joined in opposing relation with said outer shell on an inner side thereof, one of said inner and outer shells including an upwardly extending channel having an open side enclosed by the other of said inner and outer shells to define a structurally hollow tube in each of said first and second side walls, said top and bottom walls being in vertically spaced relation to define a hollow interior which opens through a front of said enclosure, said enclosure including channel means defining an inwardly opening channel at a lower end of each of said first and second side walls for receiving an edge region of said bottom wall therein to connect said bottom wall at least to said first and second side walls, said bottom wall being a solid non-metal material;

fastening means engaged with said enclosure and embedded substantially in said solid material for said connection of said bottom wall to said channel means; and a plurality of drawers disposed vertically adjacent to each other in said hollow interior above said bottom wall, each said drawer including support means for slidably connecting said drawer to said enclosure so as to be slidable into and out of said hollow interior between retracted and extended positions, said solid non-metal material having a density of at least 25 pounds per cubic foot so that said drawers are counterbalanced when in said extended position.

16. The file cabinet according to claim 15, wherein said channel means is defined by upper and lower flanges which project horizontally inwardly from said enclosure and are vertically spaced to define an inward-opening channel therebetween, said flanges being disposed below said support means.

17. The file cabinet according to claim 16, wherein said fastening means comprise a plurality of fasteners which project vertically through both of said upper and lower flanges into said solid material of said bottom wall.

18. The file cabinet according to claim 15, wherein said solid material comprises a manufactured wood material.

19. In a lateral file cabinet including a hollow box-like enclosure which has a hollow interior and defines a front opening on a front thereof, said enclosure being defined by first and second laterally spaced apart side walls extending upwardly, a horizontally enlarged top wall extending horizontally between said side walls, and a vertically enlarged back wall connected to said side walls and said top wall and said bottom wall, said file cabinet including a plurality of laterally elongate drawers which extend horizontally between said side walls and are slidably received within said enclosure below said top wall and slide means for connecting said drawers to said enclosure such that said drawers are disposed vertically one above the other and each said drawer is slidable into and out of said hollow interior between respective closed and open positions, comprising the improvement wherein said side walls, said top wall and said back wall are formed of sheet metal and said top wall is disposed above said drawers and is connected to said enclosure proximate said side walls along respective side regions thereof, said top wall including a sheet metal outer housing which defines an interior chamber having a transverse width defined between opposite first and second housing sides of said housing and an opening which opens vertically into said interior chamber, said opening having opposite first and second side edges defined by said housing which are spaced transversely from said first and second housing sides respectively to define a transverse width of said opening which is less than said transverse width of said interior chamber, said top wall including a top panel which has a transverse width which is proximate said transverse width of said interior chamber but is less than a distance between said first housing side and said second side edge, said transverse width of said top panel being greater than said transverse width of said opening such that said top panel is insertable through said opening into said interior chamber but is supported on its opposite panel sides by said housing adjacent said first and second side edges of said opening, said top panel being a solid non-metal material which strengthens said top wall, and having a density of about 25 pounds per cubic foot or more.

20. The file cabinet according to claim 19, wherein said first and second side edges are defined by respective first and second flanges which extend transversely away from said first and second housing sides, said opposite panel sides being supported on said first and second flanges respectively.

21. The file cabinet according to claim 20, wherein said top wall includes fasteners which secure said opposite panel sides to said first and second flanges respectively.

22. The file cabinet according to claim 19, wherein said side walls include sidewardly extending flanges at the top ends thereof and first fasteners which fixedly secure said top panel of said top wall to said flanges.

23. The file cabinet according to claim 22, wherein said top wall includes second fasteners which fixedly secure said housing to said top panel.

* * * * *